US006210278B1

(12) United States Patent
Klitsner

(10) Patent No.: US 6,210,278 B1
(45) Date of Patent: Apr. 3, 2001

(54) HAND-HELD VOICE GAME

(75) Inventor: Daniel B. Klitsner, Larkspur, CA (US)

(73) Assignee: Klitsner Industrial Design, LLC, San Francisco, CA (US)

( * ) Notice: Subject to any disclaimer, the term of this patent is extended or adjusted under 35 U.S.C. 154(b) by 0 days.

(21) Appl. No.: 09/304,637

(22) Filed: May 4, 1999

Related U.S. Application Data

(63) Continuation-in-part of application No. 08/933,994, filed on Sep. 19, 1997, now Pat. No. 6,086,478.

(51) Int. Cl.[7] ..... A63F 13/00; A63F 9/24; G06F 17/00; G06F 19/00

(52) U.S. Cl. ..... 463/35; 463/7; 463/37; 463/46; 273/273; 273/440; 273/445; 273/446; 273/460

(58) Field of Search ..... 463/35, 2, 3, 4, 463/5, 6, 7, 8, 1, 30, 36, 37, 46; 273/237, 273, 440, 445, 454, 455, 460; 436/247, 258

(56) References Cited

U.S. PATENT DOCUMENTS

| | | | | |
|---|---|---|---|---|
| 3,748,748 | * | 7/1973 | Bevan et al. | 434/318 |
| 3,851,875 | * | 12/1974 | Breslow et al. | 273/138.2 |
| 3,982,764 | * | 9/1976 | Dieball | 273/237 |
| 4,095,785 | * | 6/1978 | Conner | 463/7 |
| 4,285,517 | * | 8/1981 | Morrison | 463/9 |
| 4,285,519 | | 8/1981 | di Donato . | |
| 4,298,198 | * | 11/1981 | Huang et al. | 463/7 |
| 4,309,030 | | 1/1982 | Goldfarb et al. . | |
| 4,326,710 | * | 4/1982 | Breslow et al. | 273/1 E |
| 4,363,482 | * | 12/1982 | Goldfarb | 463/9 |
| 4,418,908 | | 12/1983 | Kinberg . | |
| 4,729,564 | | 3/1988 | Kuna et al. . | |
| 4,770,416 | | 9/1988 | Shimizu et al. . | |
| 4,957,291 | * | 9/1990 | Miffitt et al. | 463/9 |
| 4,974,833 | | 12/1990 | Hartman et al. . | |
| 5,009,419 | | 4/1991 | Streeter . | |
| 5,060,941 | | 10/1991 | Barra . | |
| 5,271,627 | | 12/1993 | Russell et al. . | |
| 5,286,037 | | 2/1994 | Ghaly . | |
| 5,289,389 | | 2/1994 | Keller . | |
| 5,312,114 | * | 5/1994 | Lipson | 434/236 |
| 5,405,153 | * | 4/1995 | Hauck | 273/460 |
| 5,413,486 | | 5/1995 | Burrows et al. . | |
| 5,478,267 | | 12/1995 | McDonald et al. . | |
| 5,630,754 | * | 5/1997 | Rebane | 463/9 |
| 5,685,776 | * | 11/1997 | Stambolic et al. | 463/46 |
| 6,086,478 | * | 7/2000 | Klitsner et al. | 463/35 |

* cited by examiner

*Primary Examiner*—Jessica J. Harrison
*Assistant Examiner*—Binh-An D. Nguyen
(74) *Attorney, Agent, or Firm*—Morgan & Finnegan, L.L.P.

(57) ABSTRACT

A hand-held game that includes a plurality of input devices, an audible output device, and a controller coupled to each of the input devices and to the audible output device. Preferably, each of the input devices require a different mechanical action for action, such as a pressure switch, a pull switch or a rotational switch. The controller outputs a first command signal to the audible output device that relates to a first selected input device. The controller then outputs a second command signal to the audible output device relating to a second selected input device when the first selected input device is actuated within a predetermined period of time. When the first selected input device is not actuated within the predetermined period of time, or when an input device other than the selected input device is actuated in response to the first command signal, the controller outputs an error command signal to the audible output device. The controller then ceases to output command signals to the audible output device after outputting the error command signal. According to the invention, the second command can relate to a second selected input device or can be an audible indication, such as a voice message, for a user to pass the game apparatus to another user.

25 Claims, 4 Drawing Sheets

HAND-HELD VOICE GAME

RELATED APPLICATIONS

This application is a continuation in part of U.S. patent application Ser. No. 08/933,994, filed Sep. 19, 1997 now U.S. Pat. No. 6,086,478.

BACKGROUND OF THE INVENTION

1. Field of the Invention

The present invention relates to the field of games. More particularly, the present invention relates to an apparatus and a method for a hand-held voice game of elimination played by a single player or by multiple players.

2. Description of the Related Art

Apparatuses are known for playing a game that generates voice instructions or sound prompts by the game apparatus. A player listens to a voice or sound prompt produced by the game apparatus and performs a predetermined operation in accordance with the voice or sound prompt.

For example, U.S. Pat. No. 4,770,416 to Shimizu et al. discloses a vocal game device in which players record voice commands corresponding to selected operations that are to be performed by the players. The Shimizu et al. device includes four input switches that are each a different color and contain a lamp for lighting. Players respond to the voice commands generated by the device and the lighting of the lamps during the course of play.

Another device, disclosed by U.S. Pat. No. 5,271,627 to Russell e al., provides audible sounds indicating particular targets that are active for a player to strike. The targets are spatially located around a player and when a target becomes active, a sound prompt is generated and the target is lighted so that the player can quickly identify and strike the active target.

While both of the devices provide sound prompts for instructing a player to perform a specified action, the player does not need to decide between actions of a different nature during the course of play. For the Shimizu et al. device a player presses a specific key or sequence of keys. For the Russell et al. device, a player strikes an active target. Neither game device requires a player to select between different operations depending upon the sound prompt. Consequently, what is needed is a game that requires a player to select between different operations depending on the sound prompt generated by the game.

SUMMARY OF THE INVENTION

The present invention provides a game that requires a player to select between different operations depending on the sound prompt generated by the game. In that regard, the present invention provides a hand-held game that includes a plurality of input devices, an audible output device, and a controller coupled to each of the input devices and to the audible output device. Preferably, each of the input devices require a different mechanical action for action, such as a pressure switch, a pull switch or a rotational switch. The controller outputs a first command signal to the audible output device that relates to a first selected input device. The controller then outputs a second command signal to the audible output device relating to a second selected input device when the first selected input device is actuated within a predetermined period of time. When the first selected input device is not actuated within the predetermined period of time, or when an input device other than the selected input device is actuated in response to the first command signal, the controller outputs an error command signal to the audible output device. The controller then ceases to output command signals to the audible output device after outputting the error command signal. According to the invention, the second command can relate to a second selected input device or can be an audible indication such as a voice message, for a user to pass the game apparatus to another user.

Preferably, the audible output device outputs a different voice message corresponding to each respective command signal. For example, the voice message corresponding to a command signal relating to the pressure switch instructs a user to press the pressure switch. Similarly, the voice message corresponding to a command signal relating to the pull switch instructs the user to pull the pull switch, and the voice message corresponding to a command signal relating to the rotational switch instructs the user to rotate the rotational switch.

The audible output device also can output a different musical sound or prompt corresponding to each respective command signal. For example, the music sound corresponding to a command signal relating to the pressure switch indicates for a user to press the pressure switch, while the musical sound corresponding to a command signal relating to the pull switch indicates for the user to pull the pull switch, and the musical sound corresponding to a command signal relating to the rotational switch indicates for the user to rotate the rotational switch.

BRIEF DESCRIPTION OF THE DRAWING

The present invention is illustrated by way of example and not limitation in the accompanying figures in which like reference numerals indicate similar elements and in which.

DETAILED DESCRIPTION

Figure 1A:
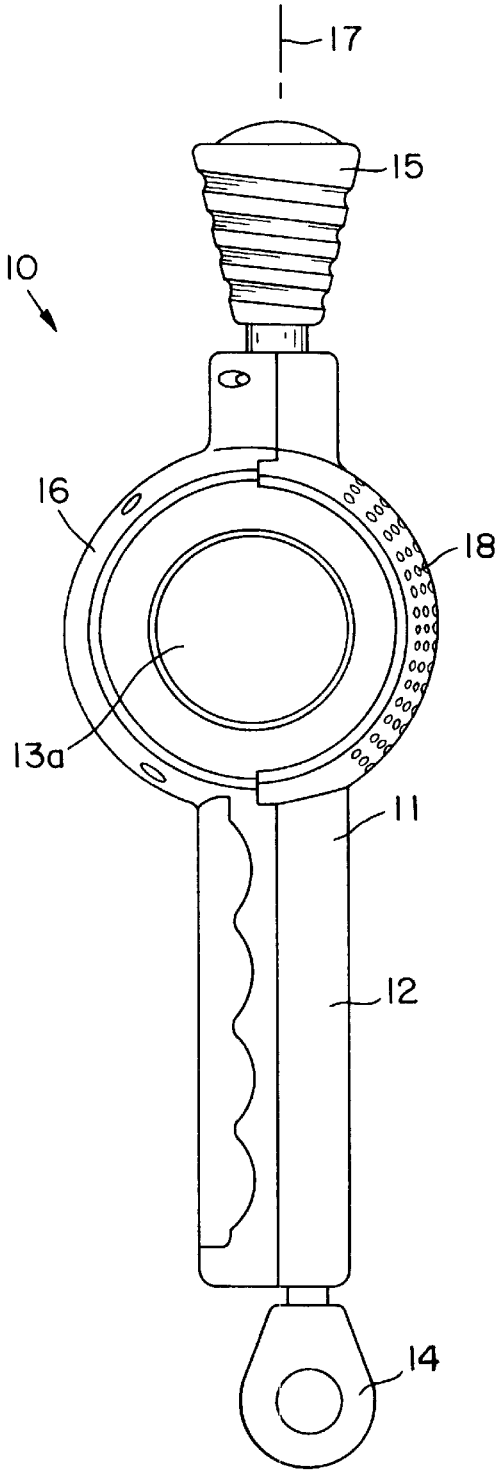
FIGS. 1A and 1B respectively show a front and a side view of a first preferred embodiment of the present invention.
Figure 1B:
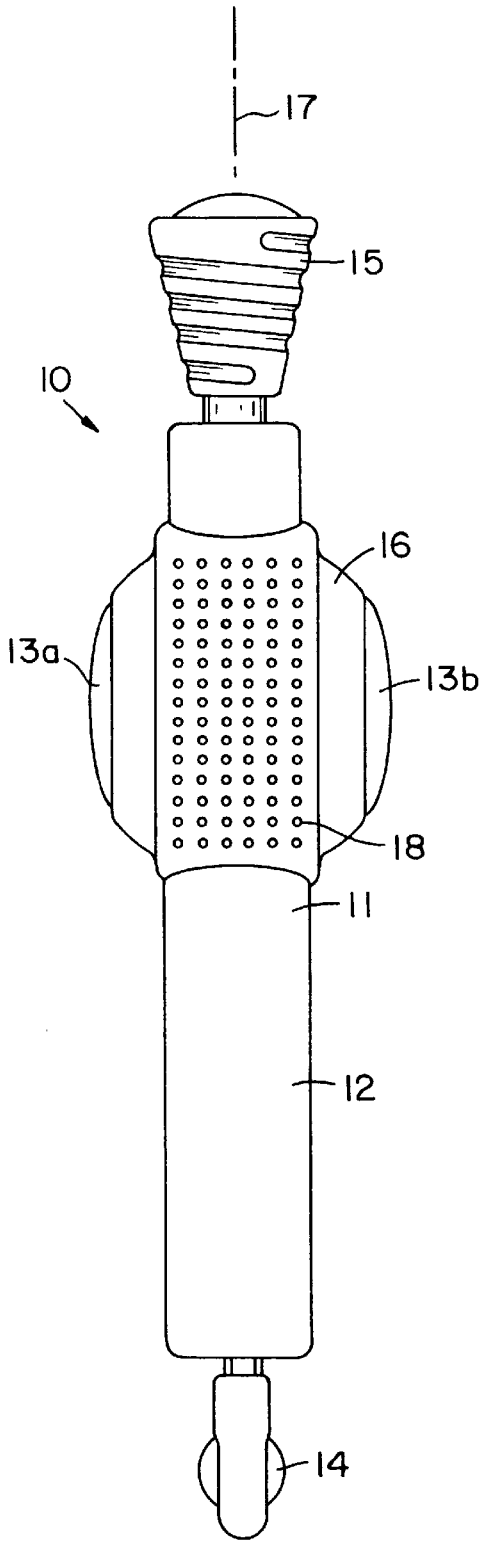

FIGS. 1A and 1B respectively show a front and a side view of a first preferred embodiment of the hand-held game 10 of elimination according to the present invention. According to the invention, the game provides audible signals instructing a player to actuate a particular input device, such as a pressure switch, a pull switch or a rotational switch. If the particular input device is not actuated within a predetermined period of time, such as a second, the game outputs an audible error signal, stopping play and indicating that the player who failed to actuate the input device is eliminated from that round of play. The audible signals instructing a player to actuate an input device can be selected to be either voice messages or musical sounds, or prompts, corresponding to each input device.

In FIGS. 1A and 1B, game 10 has a housing 11 that is formed for providing a convenient gripping portion end 12 for holding game 10 in by hand. Three different types of actuation devices are accessible at different locations on game 10. Two pressure switches 13*a* and 13*b*, referred to herein as a bop it buttons, are located at each end of a cylindrical portion 16 of housing 11 so that a player may actuate a bop it button at either of two locations. A pull-switch 14, herein referred to as a pull knob, is located at the gripping portion end 12 of housing 11. Pull knob 14 is actuated by pulling the knob along an axial axis 17 extending along gripping portion 12. A rotational switch 15, herein referred to as a twist knob, is located at the end of housing 11 that is opposite gripping portion end 12. Twist knob 15 is actuated by rotating twist knob around axial axis 17. Housing 11 provides an area of openings 18 so that sound produced by an audible output device, such as a speaker, can be heard during the course of play.

Figure 2:
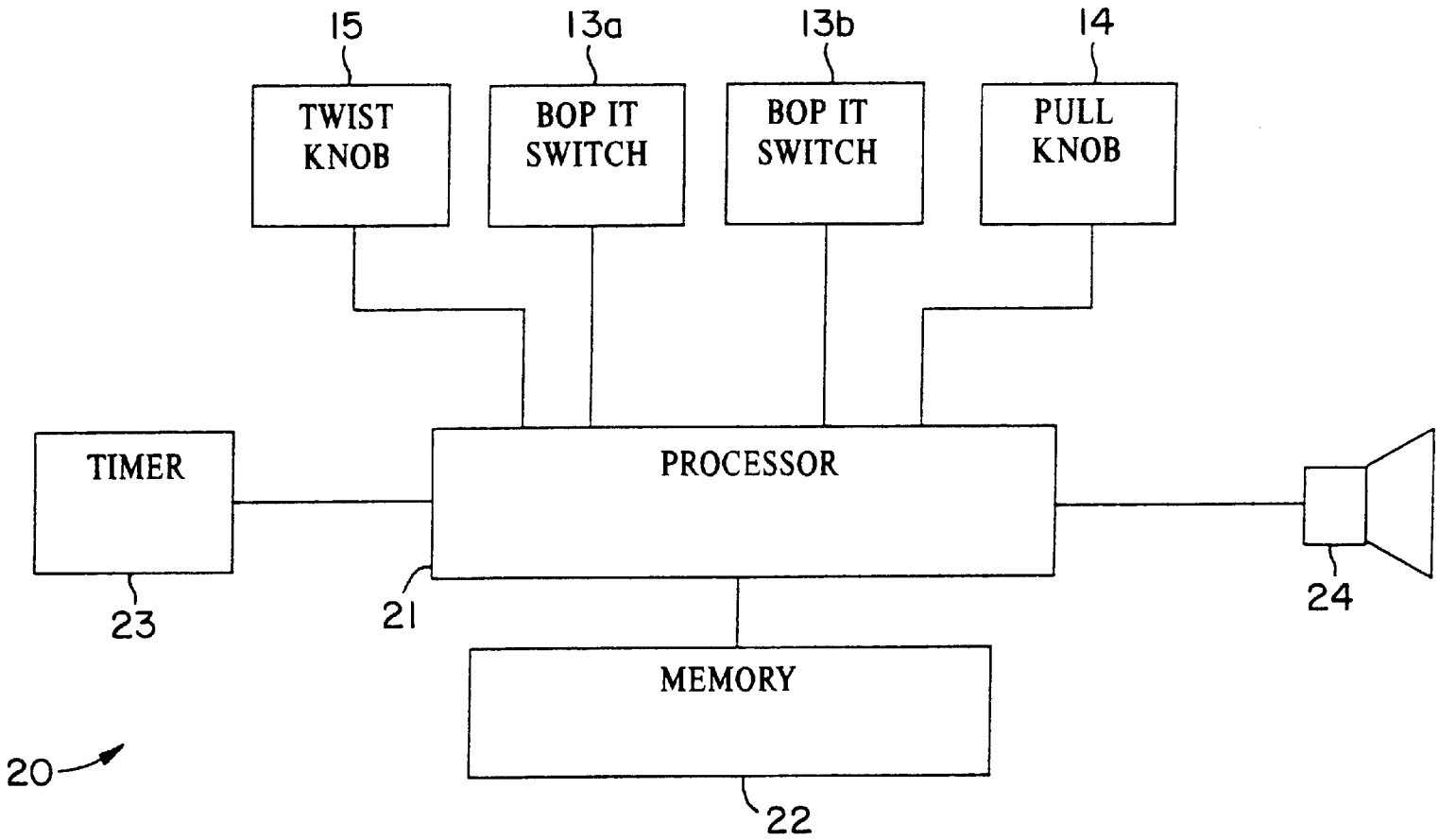
FIG. 2 shows a schematic block diagram of a first preferred embodiment of the present invention.

FIG. 2 shows a schematic block diagram 20 of the present invention. A processor or controller 21 is connected to a memory 22, a timer 23, an output device 24, bop it buttons 13*a* and 13*b*, pull knob 14 and twist knob 15. Memory 22 stores instructions that are executable by processor 21 for providing the three different game formats described below. Memory 22 also stores data relating to voice instructions and relating to musical sounds or prompts that are generated during the course of play. Timer 23 is used for measuring a predetermined period of time, such as a second, in which a selected input device must be actuated for game play to progress and for generating a game tempo that increases randomly as game play progresses. Processor 21, memory 22 and timer 23 are readily available integrated circuits that have operational capabilities that are suitable for providing the functions of the present invention. Additionally, the functions of the present invention can be performed by an application specific integrated circuit (ASIC), by dedicated logic circuits or by a state machine.

Output device 24, such as a speaker, receives command signals generated by processor 21 during the course of play and generates audible voice instructions or musical prompts. Alternatively, if processor 21 does not have the capability to drive speaker 24 directly, an output conditioning device can be used for conditioning the command signals in a well-known manner for driving speaker 24.

Processor 21 receives actuation signals generated by each of bop it buttons 13*a* and 13*b*, pull knob 14 and twist knob 15, and determines whether the actuation signal corresponds to the selected input device a player was instructed to actuate. If a player actuates the correct input device in response to an instruction within the predetermined period of time, processor selects another input device at random and generates corresponding command signals for output to speaker 24. If a player actuates an incorrect input device, or does not actuate the correct input device within the predetermined period of time, as measured by timer 23, processor 21 generates an error command signal for output to speaker 24, such as a scream and/or a drum tag, or other appropriate error sound. Pull knob 14 is used for selecting one of three different game formats for play by pulling the knob an appropriate number of times for each particular game format, and for repeating a players score after a round in one of the game formats. A bop it button is actuated to start a game once a particular game format has been selected, or to start a new round.

The first game format, for 2 or more players, outputs audible voice messages instructing a player to "bop it", "pull it", or "twist it", along with an audible underlying beat. The first player hits a bop button to start play and, after one measure of the underlying beat, must follow the voice instructions generated by the game in tempo with the underlying beat by performing an appropriate operation within a relatively short period of time, such as a second. At the end of a player's turn, indicated by a voice instruction to "pass it", the game is passed to the next player, such as to the player to the left, during a measure of pass it music. Game play continues in this manner until a player makes a mistake by either failing to perform the specified instructions within the set period of time or by performing the instruction incorrectly. When this occurs, the game generates a scream sound, indicating that the current player has been eliminated, and play stops. The remaining players continue play in the same manner until one player remains, who is the winner. The tempo of the game increases randomly as the game progresses.

The second game format, for 2 or more players, is essentially the same as the first format, but rather than providing game play through verbal instructions, the present invention provides instructions in the form of musical sounds, or prompts, to which game players must respond. That is, when the present invention produces, for example, a drumming-type sound, a player must hit a bop it button 13*a* or 13*b*. When a pull sound is produced, such as a sliding scale of tones, a player must pull pull knob 14. Similarly, when a twist sound, such as a ratcheting sound, is produced, a player must twist twist knob 15.

In the second game format, the first player hits a bop button to start play and, after one measure of the underlying beat, must follow the musical prompts generated by the game in tempo with the underlying beat by performing an appropriate operation within a relatively short period of time. At the end of a player's turn, indicated by a musical prompt to pass it, the game is passed to the next player, such as to the player to the left, during a measure of pass it music. Game play continues in this manner until a player makes a mistake by either failing to perform the specified action within the set period of time or by performing the action incorrectly. When this occurs, the game generates a scream sound, indicating that the current player has been eliminated, and play stops. The remaining players continue play in the same manner until one player remains, who is the winner. The tempo of the game randomly increases as the game progresses.

In the third game format, the present invention is adapted for use by a solo game player or for one player at a time. In this format, the present invention provides voice instructions that must be followed by the game player. A player hits a bop button to start play and, after one measure of the underlying beat, must follow the voice instructions generated by the game in tempo with the underlying beat by performing an appropriate operation within a relatively short period of time. Game play continues in this manner until the player makes a mistake by either failing to perform the specified action within the set period of time or by perfoming the action incorrectly. When the player commits an error during play, an error sound is first produced and then an indication of the player's score is audibly produced, such as by a count of drum beats. The pull knob can be pulled before start of another game to hear the player's score again. The tempo of the game randomly increases as the game progresses.

Figure 3:
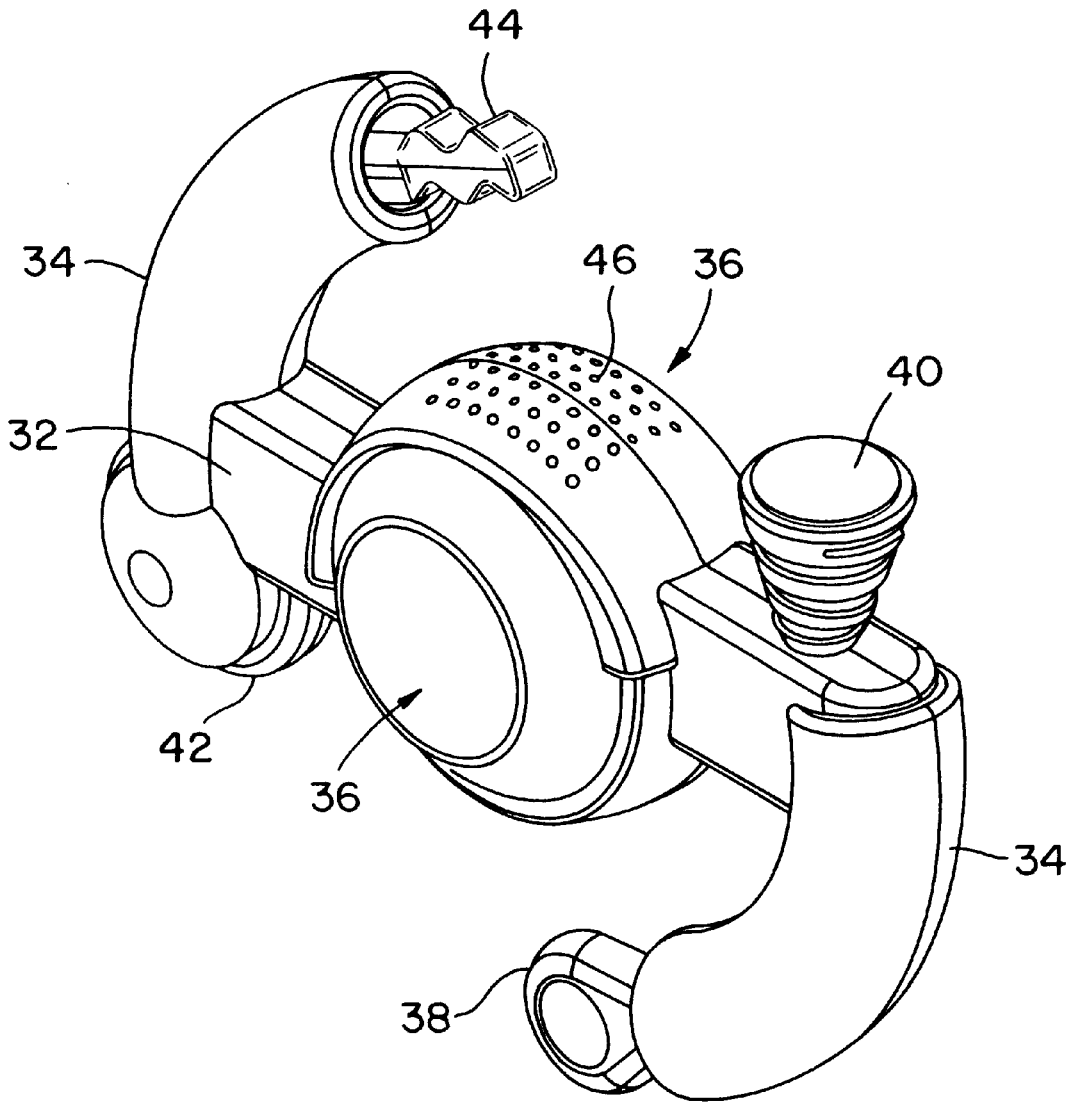
FIG. 3 shows a perspective view of a second preferred embodiment of the present invention.
Figure 4:
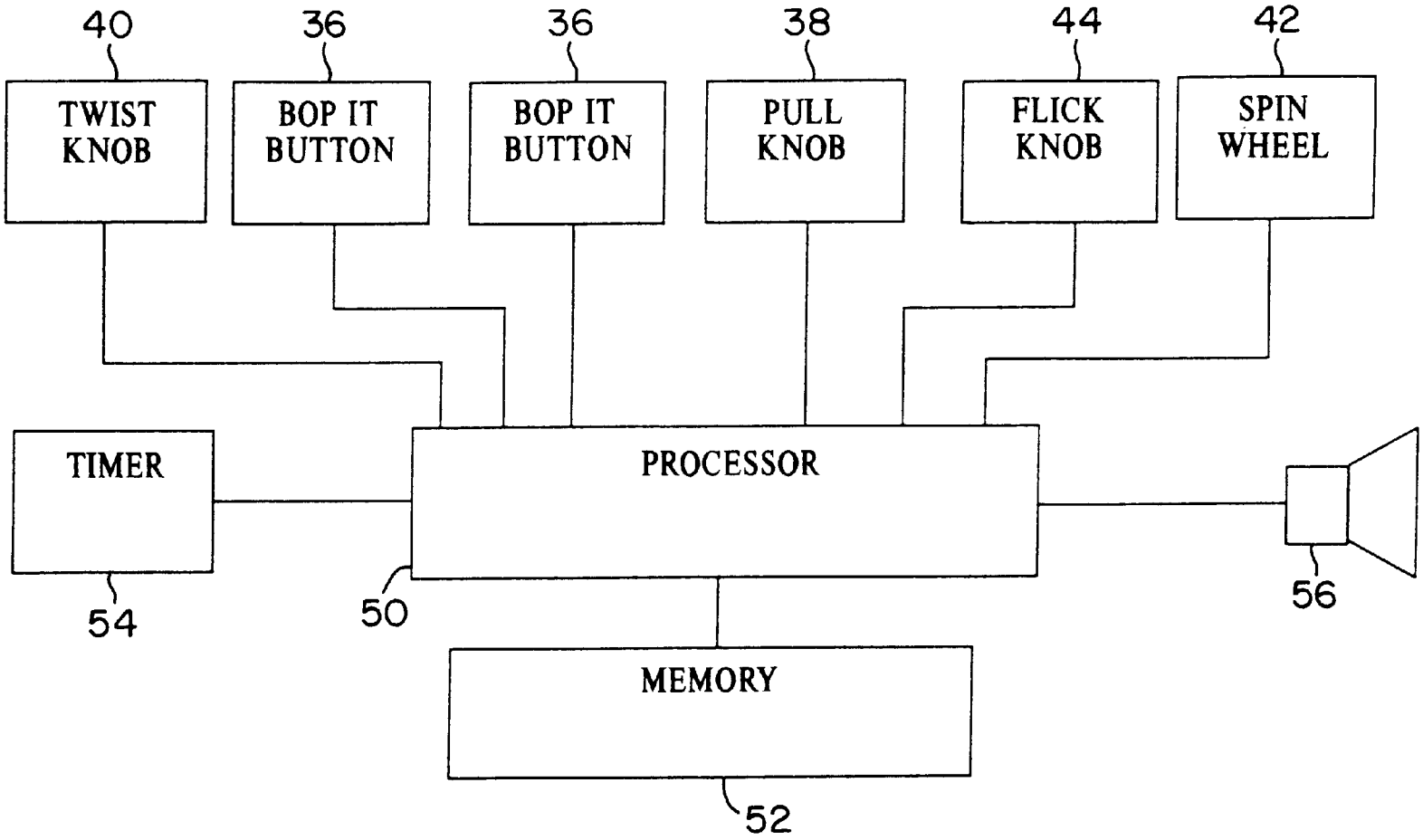
FIG. 4 shows a schematic block diagram of a second preferred embodiment of the present invention.

A second preferred embodiment of the present invention, game 30 is shown in FIGS. 3 and 4. Game 30 is a hand-held game of elimination 30 that can have, for example, four game formats and five different types of actuation devices. According to this embodiment of the invention, the game 30 provides audible signals instructing a player to actuate a particular input device, such as a pressure switch, a pull switch, a rotational switch, a spin switch or a lever switch. If the particular input device is not actuated within a predetermined period of time, such as a second, the game outputs an audible error signal, stopping play and indicating that the player who failed to actuated the input device is eliminated from that round of play. The audible signals instructing a player to actuate an input device can be selected to be either voice messages or musical sounds, or prompts, corresponding to each input device.

In FIG. 3, game 30 has a housing 32 that provides two handle portions 34, for convenient gripping by hand. Five different actuation types of input devices are accessible at different locations on game 30. Each of two bop it buttons 36, is located on each side of the housing 32, so that a player may actuate a bop it button at either of two locations by a pushing action. A pull knob 38 is actuated by pulling the knob 38 along its longitudinal axis parallel to the curvature of the handle portion 34 where the pull knob 38 is fixed, by a pulling action. A twist knob 40, is actuated by rotating the knob 40 about its longitudinal axis parallel to the axis of curvature of the handle portion 34 where the twist knob 40 is fixed, by a twisting action. A spin switch, herein referred to as a spin wheel 42, is rotatably connected at its center to the housing 32, and is actuated by a spinning action. A lever switch, herein referred to as a flick knob 44, is actuated by pushing the switch 44 perpendicularly to its longitudinal axis, by a flicking action. Housing 32 provides an area of openings 46 so that sound produced by an audible output device, such as a speaker, can be heard during the course of play.

FIG. 4 shows a schematic block diagram of the second preferred embodiment of the present invention. A processor or controller 50 is connected to a memory 52, a timer 54, an output device 56, bop it buttons 36, pull knob 38, a twist knob 40, a spin wheel 42, and a flick knob 44. Memory 52 stores instructions that are executable by processor 50 for providing four different game formats described below. Memory 52 also stores data relating to voice instructions and relating to musical sounds or prompts that are generated during the course of play. Timer 54 is used for measuring a predetermined period of time, such as a second, in which a selected input device must be actuated for game play to progress and for generating a game tempo that increases randomly as game play progresses. Processor 50, memory 52 and timer 54 are readily available integrated circuits that have operational capabilities that can be suitable for providing the functions of the present invention. Additionally, the functions of the present invention can be performed by an application specific integrated circuit (ASIC), by dedicated logic circuit.

Output device 56 such as a speaker, receives command signals generated by processor 50 during the course of play and generates audible voice instructions or musical prompts. Alternatively, if processor 50 does not have the capability to drive speaker 56 directly, an output conditioning device can be used for conditioning the command signals in a will-known manner for driving speaker 56.

Processor 50 receives actuation signals generated by either bop it button 36, pull knob 38, twist knob 40, flick knob 44, or spin wheel 42, and determines whether the actuation signal corresponds to the selected input device a player was instructed to actuate. If a player actuates the correct input device in response to an instruction within the predetermined period of time, processor 50 selects another input device at random and generates corresponding command signals for output to speaker 24. If a player actuates an incorrect input device, or does not actuated the correct input device within the predetermined period of time, as measured by timer 54, processor 50 generates an error command signal for output to speaker 56, such as a scream and/or a drum tag, or other appropriate error sound. Pull knob 38 is used for selecting one of four different game formats for play by pulling the pull knob 38 an appropriate number of times for each particular game format, and for repeating a player's score after a round in one of the game formats. A bop it button 36 is actuated to start a game once a particular game format has been selected, or to start a new round.

For example, game format one, herein referred to as Vox Bop, may be selected by pulling pull knob 38 once. Vox Bop is a game format for more than one player. The objective of Vox Bop is to be the last player "alive" by correctly reacting to commands output by speaker 56. "Alive" players are those who have not received an error prompt or message after failing to actuate the correct input device in a timely fashion. Once Vox Bop is selected a player may begin the game by pressing a bop it button 36. This will initiate and underlying beat. After one measure of beat, processor 50 outputs a command signal to the speaker 56 and game voice prompts such as "bop it", "pull it," "twist it," "spin it," or "flick it" begin. Player must actuate the button or knob that corresponds to the indicated prompt. Prompts can be called out randomly in tempo to the beat. If the player responds correctly and within the time period given to the prompt, the player will hear an audio response appropriate to that switch. If the player actuates the wrong switch or does not respond within the time period given the game pauses, and an error message or prompt is output by the speaker 56 in response to an error signal output by the processor 50. While Vox Bop is paused, the underlying beat stops. The player who commits the error is out and the game 30 is passed to the next player. The Vox Bop continues when the next player actuates or presses the bop it button 36. Alternatively while playing the game, a player may receive a "pass it" command. The "pass it" command may be generated randomly. The player must then pass game 30 to the next player. The tempo of the underlying beat may be increased, such as by random increments during the course of play. The Vox Bop ends when only one player remains "alive".

A second game format can be, for example, similar to Vox Bop, but instead of voice prompts command and error prompts may be announced with characteristic noises or musical sounds instead of voice prompts in a commonly known language. This game format may be selected, for example, by pulling the pull it knob 38 twice, then started by pressing the bop it button 36.

A third game format can be designed for solo players, or for one player at a time. The game format may be selected, for example, by pulling the pull it knob 38 three times. This game format may be similar to the first game format except that no "pass it" command is issued, and the player's score is automatically announced after an error prompt.

A fourth game format can be designed for solo players, or for one player at a time. The game format may be selected, for example, by pulling the pull it knob 38 four times. This game format may be similar to the second game format except that no "pass it" command is issued, and the player's score is automatically announced after an error prompt.

At the end of a game format the high score for that game 30 may be accessed by actuating, for example, the twist knob 40. The high score is the highest score achieved a player on that game 30. The high score may be announced by the output device 56 in response to a signal from the processor 50.

While the present invention has been described in connection with the illustrated embodiments, it will be appreciated and understood that modifications may be made without departing from the true spirit and scope of the invention.

What is claimed is:

1. A game apparatus for one or more users, comprising:

at least three input devices each requiring a mechanical action for actuation, wherein at least one of said input devices requires a spinning or a flicking mechanical action for actuation and wherein at least two of the mechanical actions are different;

an audible output device; and a controller, coupled to each of the input devices and to the audible output device, for:

selecting an input device;

outputting a command signal to the audible output device specific to the input device selected;

detecting whether the selected input device is actuated within a desired elapsed time;

outputting an error signal to the audible output device if a non-selected input device is actuated by a user;

outputting an error signal to the audible output device if the selected input device is not actuated by a user within the desired elapsed time.

2. The game apparatus according to claim 1, wherein the controller ceases to output command signals to the audible output device after outputting the error command signal.

3. The game apparatus according to claim 1, wherein the controller operates to automatically perform operations in a specified sequence.

4. The game apparatus according to claim 3, wherein the controller can reexecute the operations if the controller detects that the selected input device is actuated within a desired elapsed time.

5. The game apparatus according to claim 3, wherein the mechanical actions are pushing, twisting, spinning, flicking or pulling actions.

6. The game apparatus according to claim 3, wherein the input devices include a pressure switch, a pull switch, a rotational switch, a spin wheel, and a lever switch.

7. The game apparatus according to claim 6, wherein the controller causes the audible output device to output a different voice message corresponding to each respective command signal.

8. The game apparatus according to claim 7, wherein the voice message corresponding to a command signal relating to the pressure switch instructs a user to press the pressure switch, the voice message corresponding to a command signal relating to the pull switch instructs the user to pull the pull switch, and the voice message corresponding to a command signal relating to the rotational switch instructs the user to rotate the rotational switch, the voice message corresponding to a command signal relating to the spin wheel instructs the user to spin the spin wheel, and the voice message corresponding to a command signal relating to the lever switch instructs the user to flick the lever switch.

9. The game apparatus according to claim 7, wherein the controller outputs a pass command signal to the audible output device immediately after the controller detects that the selected input device has been actuated within a desired elapsed time, and wherein in response to the pass command signal the audible output device outputs a voice message for a user to pass the game apparatus to another user.

10. The game apparatus according to claim 6, wherein the controller causes the audible output device to output a different musical sound corresponding to each respective command signal.

11. The game apparatus according to claim 10, wherein the musical sound corresponding to a command signal relating to the pressure switch instructs a user to press the pressure switch, the musical sound corresponding to a command signal relating to the pull switch instructs the user to pull the pull switch, the musical sound corresponding to a command signal relating to the rotational switch instructs the user to rotate the rotational switch, the musical sound corresponding to a command signal relating to the spin wheel instructs the user to spin the spin wheel, and the musical sound corresponding to a command signal relating to the lever switch instructs the user to flick the lever switch.

12. The game apparatus according to claim 10, wherein the controller outputs a pass command signal to the audible output device after the controller detects that the selected input device has been actuated within a desired elapsed time, and in response to the pass command signal the audible output device outputs a musical sound for a user to pass the game apparatus to another user.

13. The game apparatus according to claim 1, wherein the game apparatus is a hand-held game.

14. A method of operating a game apparatus, wherein the game apparatus includes at least three input devices each requiring a mechanical action for actuation, wherein at least one of said input devices requires a spinning or a flicking mechanical action for actuation, and wherein at least two of the mechanical actions are different, an audible output device, and a controller coupled to each of the input devices and to the audible output device, the method comprising the steps of:

selecting with the controller one of said input devices;

outputting from the controller a command signal to the audible output device specific to the input device selected;

detecting with the controller whether the selected input device is actuated within a desired elapsed time;

outputting from the controller an error signal to the audible output device if a non-selected input device is actuated by a user and outputting from the controller an error signal to the audible output device if the selected input device is not actuated by a user within the desired elapsed time.

15. The method according to claim 14, further comprising the controller ceasing to output command signals to the audible output device after outputting the error signal.

16. The method according to claim 14, wherein the controller performs the operations automatically and in a specified sequence.

17. The method according to claim 16, wherein the mechanical actions are pushing, twisting, spinning, flicking or pulling actions.

18. The method according to claim 16, wherein the controller re-performs the sequence of operations if the controller detects that the selected input device is actuated within a desired elapsed time.

19. The method according to claim 16, wherein the input devices include a pressure switch, a pull switch, a rotational switch, a spin wheel, and a lever switch.

20. The method according to claim 19, further comprising the controller causing the audible output device to output a different voice message corresponding to each respective command signal.

21. The method according to claim 20, wherein the voice message corresponding to a command signal relating to the pressure switch instructs a user to press the pressure switch, the voice message corresponding to a command signal relating to the pull switch instructs the user to pull the pull switch, the voice message corresponding to a command signal relating to the rotational switch instructs the user to rotate the rotational switch, the voice message corresponding to a command signal relating to the spin wheel instructs the user to spin the spin wheel, and the voice message corresponding to a command signal relating to the lever switch instructs the user to flick the lever switch.

22. The method according to claim 20, further comprising the controller outputting a pass command signal to the audible output device immediately after the controller detects that the selected input device has been actuated within a desired elapsed time, and in response to the pass command signal the audible output device outputting a voice message for a user to pass the game apparatus to another user.

23. The method according to claim 19, further comprising the controller outputting a different musical sound corresponding to each respective command signal.

24. The method according to claim 23, wherein the musical sound corresponding to a command signal relating to the pressure switch instructs a user to press the pressure switch, the musical sound corresponding to a command signal relating to the pull switch instructs the user to pull the pull switch, the musical sound corresponding to a command signal relating to the rotational switch instructs the user to rotate the rotational switch the musical sound corresponding to a command signal relating to the spin wheel instructs the user to spin the spin wheel, and the musical sound corresponding to a command signal relating to the lever switch instructs the user to flick the lever switch.

25. The method according to claim 23 further comprising the controller outputting a pass command signal to the audible output device after the controller detects that the selected input device has been actuated within a desired elapsed time, and in response to the pass command signal the audible output device outputting a musical sound for a user to pass the game apparatus to another user.

* * * * *